US007766618B1

(12) United States Patent
Liang

(10) Patent No.: US 7,766,618 B1
(45) Date of Patent: Aug. 3, 2010

(54) TURBINE VANE ENDWALL WITH CASCADING FILM COOLING DIFFUSION SLOTS

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 660 days.

(21) Appl. No.: 11/821,134

(22) Filed: Jun. 21, 2007

(51) Int. Cl.
*F01D 5/08* (2006.01)

(52) U.S. Cl. ..... 416/97 R; 415/115

(58) Field of Classification Search ..... 415/115; 416/97 R

See application file for complete search history.

(56) References Cited

U.S. PATENT DOCUMENTS 4,270,883 A * 6/1981 Corrigan ..... 416/97 A
4,672,727 A 6/1987 Field
4,726,735 A * 2/1988 Field et al. ..... 416/97 R
4,738,588 A * 4/1988 Field ..... 416/97 R
4,863,348 A * 9/1989 Weinhold ..... 416/92
5,382,135 A 1/1995 Green
5,419,681 A 5/1995 Lee
5,726,348 A 3/1998 Draghi et al.
6,719,529 B2 * 4/2004 Tiemann ..... 416/97 R
6,887,033 B1 * 5/2005 Phillips et al. ..... 415/115
6,945,749 B2 * 9/2005 De Cardenas ..... 415/115
7,097,417 B2 8/2006 Liang
7,255,534 B2 * 8/2007 Liang ..... 416/97 R

* cited by examiner

*Primary Examiner*—Igor Kershteyn
(74) *Attorney, Agent, or Firm*—John Ryznic

(57) ABSTRACT

A turbine stator vane for use in a gas turbine engine, the stator vane having an endwall that forms a hot gas flow path through the vane, where the endwall includes a row of diffusion slots extending around both the pressure side and the suction side of the airfoil to provide film cooling. Each diffusion duct is connected to a plurality of film diffusion channels that are slanted with respect to the endwall surface. Each of the film diffusion channels is connected to a metering and impingement hole to supply cooling air to the slots. Cooling air is metered through the metering holes, then impinged against the diffusion channel and then diffused into the ducts and discharged as film cooling air over the endwall surface. The row of diffusion ducts extends along both sides of the airfoil and around the leading edge region to provide film cooling along the entire endwall.

20 Claims, 3 Drawing Sheets

TURBINE VANE ENDWALL WITH CASCADING FILM COOLING DIFFUSION SLOTS

CROSS-REFERENCE TO RELATED APPLICATIONS

This application is related to U.S. Regular Utility application Ser. No. 11/726,335 filed on Mar. 21, 2007 by Liang and entitled BOAS WITH MULTIPLE TRENCHED FILM COOLING SLOTS.

BACKGROUND OF THE INVENTION

1. Field of the Invention

The present invention relates generally to a gas turbine engine, and more specifically to a turbine vane with film cooling holes on the vane endwall.

2. Description of the Related Art Including Information Disclosed Under 37 CFR 1.97 and 1.98

In a gas turbine engine, the turbine section includes a multiple stages of rotor blades and stator vanes to guide the hot gas stream through the turbine and convert the hot gas flow into mechanical energy by rotating the shaft. Since the engine efficiency can be increased by passing a higher hot gas flow through the turbine, it is an important design factor to make the airfoils (blades and vanes) from the highest resistant material that will withstand the high stresses and high temperatures. It is also an important design factor to provide effective cooling with a minimal amount of cooling air since the cooling air is pressurized air from the engine compressor that is wasted and therefore will also decrease the efficiency of the engine.

The stator vanes (sometimes referred to as guide vanes or nozzles) 11 include endwalls 12 on the inner and outer ends of the vanes that form hot gas flow paths through the vanes. The stator vanes require film cooling on the airfoil part and the endwall part to prevent thermal damage. Prior art vane endwall leading edge region is cooled with a double row of circular or shaped film cooling holes 13 as seen in FIG. 1. As a result of this prior art film cooling hole arrangement, streamwise and circumferential cooling flow control due to the airfoil external hot gas temperature and pressure variation is difficult to achieve. Film cooling air discharged from the double film rows have a tendency to migrate from the pressure side toward the vane suction side surface which will induce an uneven distribution of film cooling flow and endwall metal temperature.

It is an object of the present invention to provide for a turbine vane endwall leading edge region with improved leading edge film cooling to reduce the endwall metal temperature and reduce the cooling flow requirement.

BRIEF SUMMARY OF THE INVENTION

A turbine stator vane with an endwall leading edge film cooling design. The vane endwall includes a plurality of metering and diffusion submerged film cooling channels with a cascade surface construction for the vane endwall leading edge cooling. A row of diffusion slots are spaced around the vane endwall along the pressure side and the suction side and the leading edge of the endwall. Each diffusion slot is supplied with cooling air through a plurality of metering holes that meter the cooling air flow into the slot and also produce impingement cooling. the individual metering and diffusion slots can be designed based on the local external heat load to achieve a desired local metal temperature.

DETAILED DESCRIPTION OF THE INVENTION

Figure 1:
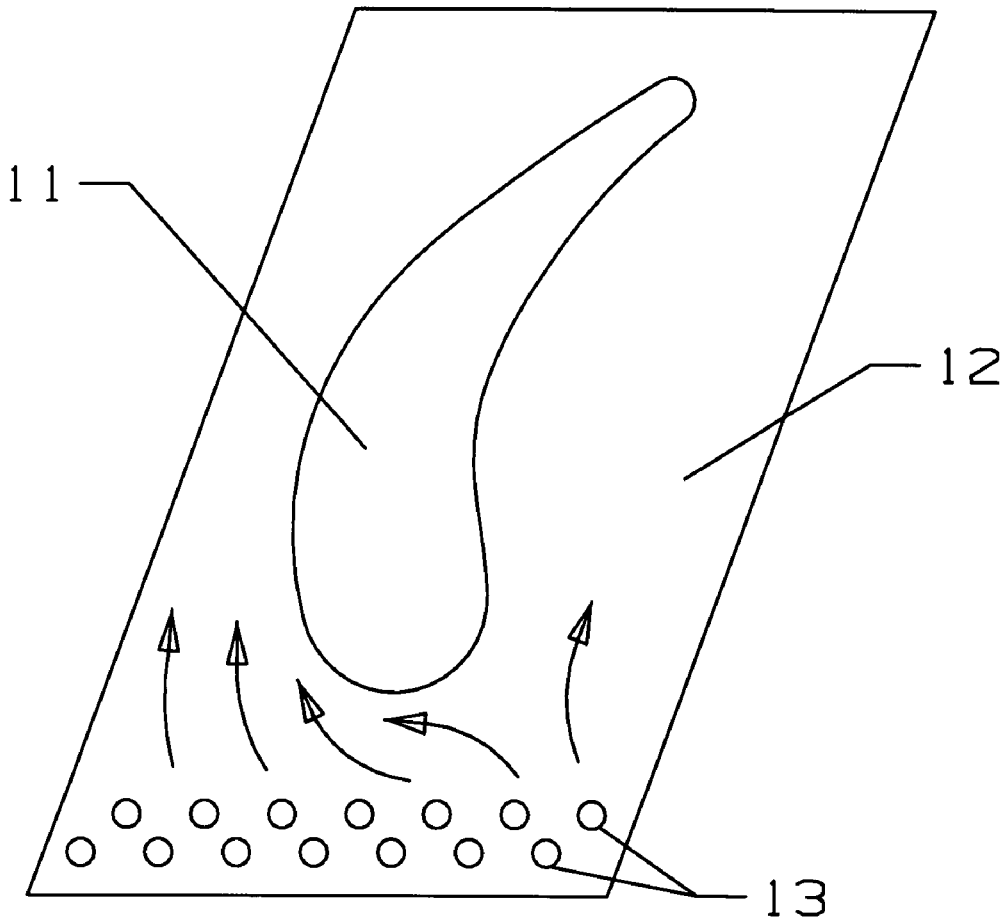
Fig 1 Prior Art
FIG. 1 shows a top view of a prior art turbine vane with endwall cooling that uses two rows of film cooling holes on the leading edge region of the endwall.
Figure 2:
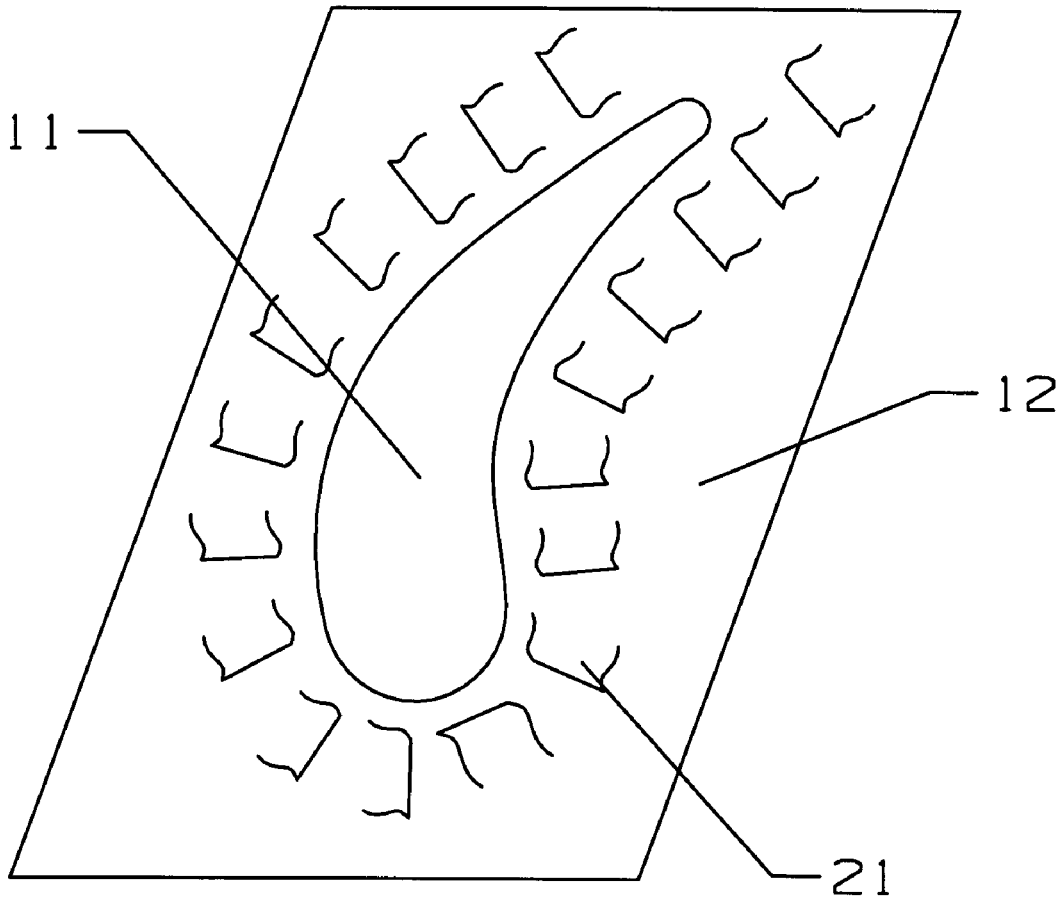
FIG. 2 shows a top view of a turbine vane endwall with the diffusion slots arranged around the airfoil of the present invention.

The present invention is a turbine stator vane with an endwall having a row of film cooling slots extending from the trailing edge and around both the pressure and suction sides of the airfoil and around the leading edge region of the endwall to provide a more effective cooling for the vane endwall. FIG. 2 shows a top view of the vane with the endwall 12 and the airfoil 11 extending upwards from the endwall 12. Only one endwall 12 is shown in the figure. However, the stator vane used in a gas turbine engine has two endwall, one outer endwall and one inner endwall that form the hot gas flow path through the vane. Each of the two endwalls will have the same film cooling arrangement that is described in FIG. 2.

Figure 3:
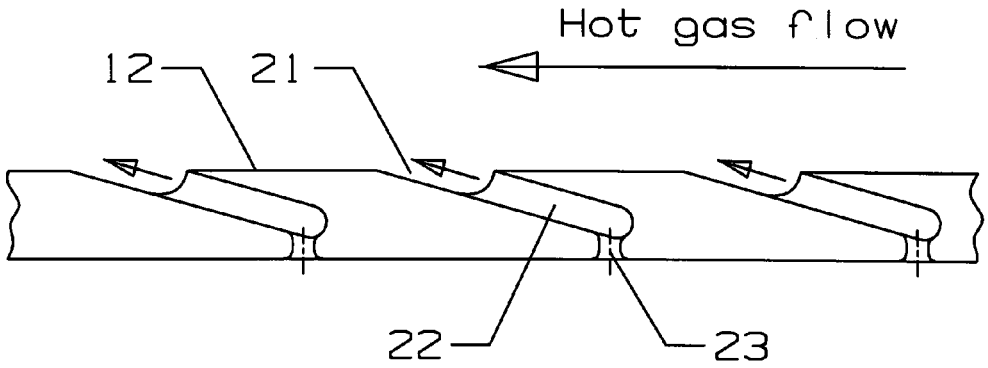
FIG. 3 shows a cross section view of three metering and diffusion slots of the present invention.

The endwall 12 includes a row of the film cooling slots that open onto the surface of the endwall in the arrangement shown in FIG. 2. Each diffusion slot 21 is connected to a plurality of film diffusion channels 22 that extends into the metal of the endwall 12 as shown in FIG. 3. The film diffusion channels 22 are angled at about 20 degrees from the surface of the endwall 12 and in a direction of the hot gas flow over the endwall.

Figure 4:
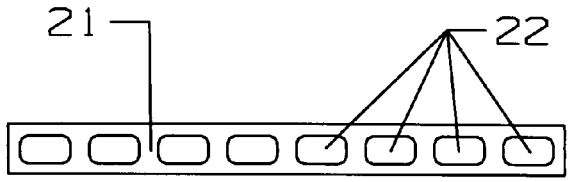
FIG. 4 shows a cross section view of one diffusion slot with a plurality of the film diffusion channels opening into the diffusion slot of the present invention.

Each film diffusion channel 22 is connected to a single metering hole 23 on the upstream end of the channel 22. The metering holes are connected to the pressurized cooling air supply for the vane. FIG. 4 shows a cross sectional view of the diffusion slot 21 on the endwall surface with a plurality of the film diffusion channels 22 opening into the slot 21. Eight diffusion channels 22 are connected to the one diffusion slot 21 in this embodiment. However, the number of diffusion channels can vary depending upon various factors such as cooling air supply pressure, the width of the diffusion slot 21, the amount of impingement cooling air used, and other factors.

Figure 5:
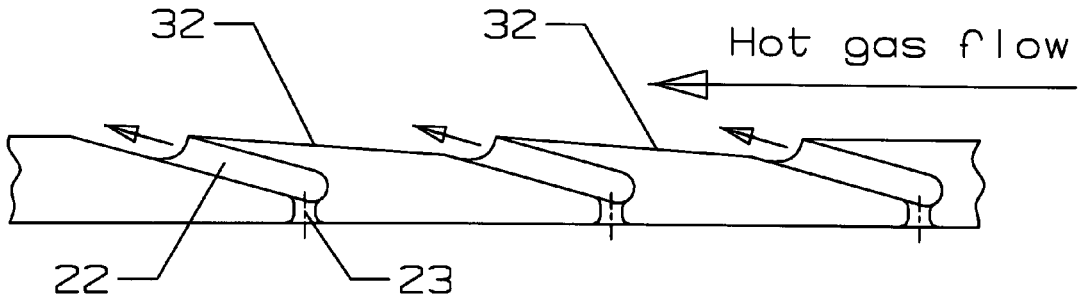
FIG. 5 shows a second embodiment of the metering hole and diffusion slot cooling design of the present invention with submerged slots on the endwall surface.

FIG. 5 shows a second embodiment of the diffusion slots used in the present invention. In the FIG. 3 embodiment, the endwall surface 12 was flat between the adjacent diffusion slots that open onto the endwall surface. In the FIG. 5 embodiment, the endwall surfaces 32 between adjacent diffusion slots is slanted in an opposite direction to the hot gas flow path over the endwall surface to form a cascade surface arrangement for the diffusion slots 21. The slanted endwall surface 32 produces a submerged diffusion slot 21 on the endwall surface. The cascade surface arrangement for the diffusion slots 21 on the endwall surface is submerged so that the discharged cooling air from the slots minimizes the shear mixing between the discharged film cooling air and the hot gas flow which enhances the cooling effectiveness for the endwall leading edge.

The submerged film cooling channels comprise of a metering cooling flow entrance section with a submerged diffusion exit channel. The multiple metering and diffusion submerged cooling slot 21 is constructed in small module formation. Individual modules are designed based on the airfoil gas side pressure distribution in both the streamwise and circumferential directions. Also, each individual module can be designed based on the airfoil local external heat load to achieve a desired local metal temperature. These individual small modules are constructed in an inline (or staggered) array along the endwall leading edge section. With this film cooling slot arrangement of the present invention, the usage of film cooling air for a given inlet gas temperature and pressure profile is maximized.

In operation, cooling air is provided by the vane cooling air supply manifold. Cooling air is metered at the entrance of the multiple metering diffusion submerged film cooling channel is closely matched and oriented to the hot gas working fluid conditions prior to being discharged from the submerged channels (if the embodiment with the submerged channels is used). Since the endwall surface is in the cascade formation, the film cooling exit channel submerged from the airfoil surface which provides proper cooling flow spacing for the discharged cooling air will minimize the shear mixing between the discharged film cooling air and the hot gas working fluid. This enhances the cooling effectiveness within the film cooling channel and reduces the film cooling air exit momentum. Coolant penetration into the gas path is minimized, yielding good buildup of the coolant sub-boundary layer next to the endwall leading edge surface, and a better film coverage in streamwise and circumferential directions for the endwall leading edge region is achieved. Also, the cascade surface is covered by the exit film which thus generates additional coverage area for the endwall leading edge region. The combination effects of additional convection cooling plus multi-diffusion film cooling at very high film coverage yields a very high cooling effectiveness and a uniform wall temperature for the vane endwall leading edge region.

I claim the following:

1. A turbine stator vane for use in a gas turbine engine, the stator vane comprising:

an endwall forming a hot gas flow path through the engine;

an airfoil extending from the endwall;

a row of diffusion slots extending along a side of the airfoil and on the endwall of the vane;

each of the diffusion slots having a width that is aligned substantially to a direction normal to the airfoil surface;

a plurality of film diffusion channels connected to each of the diffusion slots; and, a metering and impingement hole connected to each of the diffusion channels near the upstream end of the diffusion channel.

2. The stator vane of claim 1, and further comprising:

the row of diffusion slots also extends along both the pressure side and the suction side of the airfoil.

3. The stator vane of claim 2, and further comprising:

the rows of diffusion slots on the pressure side and the suction side follow the contour of the airfoil at the junction to the endwall.

4. The stator vane of claim 2, and further comprising:

the rows of diffusion slots on the pressure side and the suction side each extends from the leading edge to the trailing edge of the airfoil.

5. The stator vane of claim 1, and further comprising:

the row of diffusion slots also extends along both the pressure side and the suction side of the airfoil; and, the film diffusion channels for the diffusion slots on both sides of the airfoil are slanted with respect to the endwall surface of the vane such that cooling air exits the diffusion slots with the hot gas flow over the endwall.

6. The stator vane of claim 5, and further comprising:

the slanted diffusion channels are angled in a range of from about 10 degrees to about 30 degrees from the endwall surface of the vane.

7. The stator vane of claim 1, and further comprising:

the row of diffusion slots also extends around the leading edge region of the endwall to form one row of diffusion slots extending from the trailing edge region of the airfoil and on both sides of the airfoil.

8. The stator vane of claim 1, and further comprising:

the row of diffusion slots follows the contour of the airfoil at the junction to the endwall.

9. The stator vane of claim 1, and further comprising:

the metering hole is angled with respect to the diffusion channel to produce impingement cooling within the diffusion channel.

10. The stator vane of claim 1, and further comprising:

the diffusion slots are submerged with respect to the endwall surface.

11. The stator vane of claim 1, and further comprising:

the diffusion slots are wide enough to provide an adequate film of cooling air over the endwall of the vane.

12. A turbine stator vane for use in a gas turbine engine, the stator vane comprising:

an endwall forming a hot gas flow path through the engine;

an airfoil extending from the endwall;

a row of diffusion slots extending along a side of the airfoil and on the endwall of the vane;

each of the diffusion slots having a width that is aligned substantially to a direction normal to the airfoil surface; and, the adjacent diffusion slots are submerged to form a cascade arrangement.

13. The stator vane of claim 12, and further comprising:

each diffusion slot is connected to a plurality of film diffusion channels.

14. The stator vane of claim 13, and further comprising:

the diffusion channels are slanted with respect to the endwall surface in a range of about 10 degrees to 30 degrees.

15. The stator vane of claim 14, and further comprising:

each diffusion channel is connected to a metering and impingement hole to meter cooling air into the channel and then combined with the other diffusion channels into the diffusion slot.

16. The stator vane of claim 12, and further comprising:

the row of diffusion slots also extends along both the pressure side and the suction side of the airfoil.

17. The stator vane of claim 16, and further comprising:

the rows of diffusion slots on the pressure side and the suction side follow the contour of the airfoil at the junction to the endwall.

18. The stator vane of claim 16, and further comprising:

each of the slots on the pressure side and the suction side are submerged with the deepest surface of the submerged slot being in the upstream direction of the hot gas flow over the endwall surface.

19. The stator vane of claim 16, and further comprising:

the row of diffusion slots also extends around the leading edge region of the endwall to form one row of diffusion slots extending from the trailing edge region of the airfoil and on both sides of the airfoil.

20. The stator vane of claim 12, and further comprising:

the row of diffusion slots follows the contour of the airfoil at the junction to the endwall.

* * * * *